US009611780B2

(12) United States Patent
Gonze et al.

(10) Patent No.: US 9,611,780 B2
(45) Date of Patent: Apr. 4, 2017

(54) SYSTEMS AND METHODS FOR REMOVING FUEL FROM ENGINE OIL

(71) Applicant: GM Global Technology Operations LLC, Detroit, MI (US)

(72) Inventors: Eugene V. Gonze, Pickney, MI (US); Michael J. Paratore, Jr., Howell, MI (US); Yue-Ming Chen, Ann Arbor, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 70 days.

(21) Appl. No.: 14/804,761

(22) Filed: Jul. 21, 2015

(65) Prior Publication Data

US 2017/0022879 A1 Jan. 26, 2017

(51) Int. Cl.

| | |
|---|---|
| ***F01P 7/14*** | (2006.01) |
| ***F01P 11/08*** | (2006.01) |
| ***F01M 5/00*** | (2006.01) |

(52) U.S. Cl.

CPC ..... *F01P 7/14* (2013.01); *F01M 5/002* (2013.01); *F01P 11/08* (2013.01); *F01P 2007/146* (2013.01)

(58) Field of Classification Search

CPC ..... F01M 5/002; F01M 1/10; F01M 13/04; F01M 2001/1021; F01M 5/00; F02B 77/04; F01P 2060/16; F01P 7/14; F01P 11/08; F01P 2007/146

See application file for complete search history.

(56) References Cited

U.S. PATENT DOCUMENTS

| | | | | |
|---|---|---|---|---|
| 3,092,091 | A * | 6/1963 | Bosley | F01M 13/025 123/574 |
| 3,620,967 | A * | 11/1971 | Gulick | C10M 175/0016 208/179 |
| 5,598,705 | A | 2/1997 | Uzkan | |
| 5,730,089 | A | 3/1998 | Morikawa et al. | |
| 6,178,928 | B1 | 1/2001 | Corriveau | |
| 6,314,920 | B1 | 11/2001 | Suzuki et al. | |
| 6,390,031 | B1 | 5/2002 | Suzuki et al. | |
| 7,490,586 | B1 * | 2/2009 | Weller | F01M 9/02 123/196 S |
| 7,721,683 | B2 * | 5/2010 | Lutz | F01P 3/02 123/41.1 |

(Continued)

FOREIGN PATENT DOCUMENTS

| | | |
|---|---|---|
| CN | 101529061 A | 9/2009 |
| CN | 102052137 A | 5/2011 |

(Continued)

OTHER PUBLICATIONS

Office Action dated Aug. 14, 2014, from the German Patent Office for German Patent Application No. 10 2014 102 573.3; 5 pages.

*Primary Examiner* — Long T Tran

(57) ABSTRACT

A coolant control system of a vehicle includes a fraction module, and a coolant valve control module. The fraction module determines an oil fuel fraction based on an amount of fuel in an amount of engine oil. The coolant valve control module, based on the oil fuel fraction, selectively actuates a coolant valve to enable coolant flow from an integrated exhaust manifold (IEM) of an engine to an engine oil heat exchanger.

20 Claims, 4 Drawing Sheets

(56) References Cited

U.S. PATENT DOCUMENTS

| | | | | |
|---|---|---|---|---|
| 7,932,833 | B2 * | 4/2011 | Deivasigamani | F01P 11/18 123/22 |
| 8,104,449 | B2 | 1/2012 | Throop et al. | |
| 8,205,443 | B2 * | 6/2012 | Pegg | F01M 5/001 165/276 |
| 8,342,141 | B2 | 1/2013 | Dahl et al. | |
| 8,833,332 | B2 * | 9/2014 | Mordukhovich | C10M 175/0008 123/196 AB |
| 9,394,843 | B2 * | 7/2016 | Hakeem | F02D 41/064 |
| 2006/0042567 | A1 | 3/2006 | Figura et al. | |
| 2006/0157000 | A1 | 7/2006 | Lutze et al. | |
| 2006/0288967 | A1 | 12/2006 | Joyce et al. | |
| 2009/0283364 | A1 | 11/2009 | Throop et al. | |
| 2009/0301409 | A1 | 12/2009 | Dahl et al. | |
| 2011/0048390 | A1 | 3/2011 | Washburn | |
| 2012/0042845 | A1 * | 2/2012 | Kanai | F01M 1/10 123/196 AB |
| 2013/0186076 | A1 * | 7/2013 | Zhou | F01N 3/043 60/321 |
| 2014/0026829 | A1 * | 1/2014 | Tobergte | F01P 3/02 123/41.1 |
| 2014/0261254 | A1 * | 9/2014 | Gonze | F01P 11/08 123/41.08 |
| 2014/0372008 | A1 | 12/2014 | Bockenstette et al. | |

FOREIGN PATENT DOCUMENTS

| | | | |
|---|---|---|---|
| DE | 102009017748 | A1 | 10/2010 |
| DE | 102011120206 | A1 | 6/2013 |
| EP | 0965737 | A2 | 12/1999 |
| EP | 2243937 | A1 | 10/2010 |

* cited by examiner

SYSTEMS AND METHODS FOR REMOVING FUEL FROM ENGINE OIL

FIELD

The present disclosure relates to vehicles with internal combustion engines and more particularly to systems and methods for controlling engine coolant flow.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

An internal combustion engine combusts air and fuel within cylinders to generate drive torque. Combustion of air and fuel also generates heat and exhaust. Exhaust produced by an engine flows through an exhaust system before being expelled to atmosphere.

Vehicles that include an internal combustion engine typically include a radiator that is connected to coolant channels within the engine. Engine coolant circulates through the coolant channels and the radiator. The engine coolant absorbs heat from the engine and carries the heat to the radiator. The radiator transfers heat from the engine coolant to air passing the radiator. The cooled engine coolant exiting the radiator is circulated back to the engine.

Internal combustion engines also typically include a lubricant reservoir or sump that supplies lubricant, such as engine oil, to the engine. The engine oil lubricates various moving components throughout engine. As internal combustion engines operate, the fuel may mix with, and contaminate, the engine oil. Engine oil contaminated with fuel may have reduced lubricity, which can shorten the lifetime of the engine, engine components, and/or other components of the vehicle.

SUMMARY

A coolant control system of a vehicle includes a fraction module, and a coolant valve control module. The fraction module determines an oil fuel fraction based on an amount of fuel in an amount of engine oil. The coolant valve control module, based on the oil fuel fraction, selectively actuates a coolant valve to enable coolant flow from an integrated exhaust manifold (IEM) of an engine to an engine oil heat exchanger.

In further features, the coolant valve control module actuates the coolant valve to enable coolant flow from the IEM to the engine oil heat exchanger when the oil fuel fraction is greater than a predetermined value.

In further features, the coolant valve control module actuates the coolant valve to prevent coolant flow from the IEM to the engine oil heat exchanger when the oil fuel fraction is less than the predetermined value.

In further features, the coolant valve control module selectively actuates the coolant valve to control coolant flow from the IEM to the engine oil heat exchanger further based on at least one of a transmission temperature and an engine oil temperature.

In further features, the coolant valve control module actuates the coolant valve to enable coolant flow from the IEM to the engine oil heat exchanger when: (i) the transmission temperature is less than a predetermined temperature; and (ii) the oil fuel fraction is greater than a predetermined value.

In further features, the coolant valve control module selectively actuates the coolant valve to prevent coolant flow of from the IEM to the engine oil heat exchanger when the transmission temperature is greater than the predetermined temperature.

In further features, the coolant valve control module actuates the coolant valve to prevent coolant flow from the IEM to the engine oil heat exchanger when the oil fuel fraction is greater than the predetermined value.

In further features, the coolant valve control module actuates the coolant valve to enable coolant flow from the IEM to the engine oil heat exchanger when: (i) the engine oil temperature is less than a predetermined temperature; and (ii) the oil fuel fraction is greater than a predetermined value.

In further features, the coolant valve control module selectively actuates the coolant valve to prevent coolant flow of from the IEM to the engine oil heat exchanger when the engine oil temperature is greater than the predetermined temperature.

In further features, the coolant valve control module actuates the coolant valve to prevent coolant flow from the IEM to the engine oil heat exchanger when the oil fuel fraction is greater than the predetermined value.

A coolant control method includes: determining an oil fuel fraction based on an amount of fuel in an amount of engine oil; and, based on the oil fuel fraction, selectively actuating a coolant valve to enable coolant flow from an integrated exhaust manifold (IEM) of an engine to an engine oil heat exchanger.

In further features, selectively actuating the coolant valve includes actuating the coolant valve to enable coolant flow from the IEM to the engine oil heat exchanger when the oil fuel fraction is greater than a predetermined value.

In further features, selectively actuating the coolant valve includes actuating the coolant valve to prevent coolant flow from the IEM to the engine oil heat exchanger when the oil fuel fraction is less than the predetermined value.

In further features, selectively actuating the coolant valve to control coolant flow from the IEM to the engine oil heat exchanger further based on at least one of a transmission temperature and an engine oil temperature.

In further features, selectively actuating the coolant valve includes actuating the coolant valve to enable coolant flow from the IEM to the engine oil heat exchanger when: (i) the transmission temperature is less than a predetermined temperature; and (ii) the oil fuel fraction is greater than a predetermined value.

In further features, selectively actuating the coolant valve includes actuating the coolant valve to prevent coolant flow of from the IEM to the engine oil heat exchanger when the transmission temperature is greater than the predetermined temperature.

In further features, selectively actuating the coolant valve includes actuating the coolant valve to prevent coolant flow from the IEM to the engine oil heat exchanger when the oil fuel fraction is greater than the predetermined value.

In further features, selectively actuating the coolant valve includes actuating the coolant valve to enable coolant flow from the IEM to the engine oil heat exchanger when: (i) the engine oil temperature is less than a predetermined temperature; and (ii) the oil fuel fraction is greater than a predetermined value.

In further features, selectively actuating the coolant valve includes actuating the coolant valve to prevent coolant flow of from the IEM to the engine oil heat exchanger when the engine oil temperature is greater than the predetermined temperature.

In further features, selectively actuating the coolant valve includes actuating the coolant valve to prevent coolant flow from the IEM to the engine oil heat exchanger when the oil fuel fraction is greater than the predetermined value.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

Figure 1:
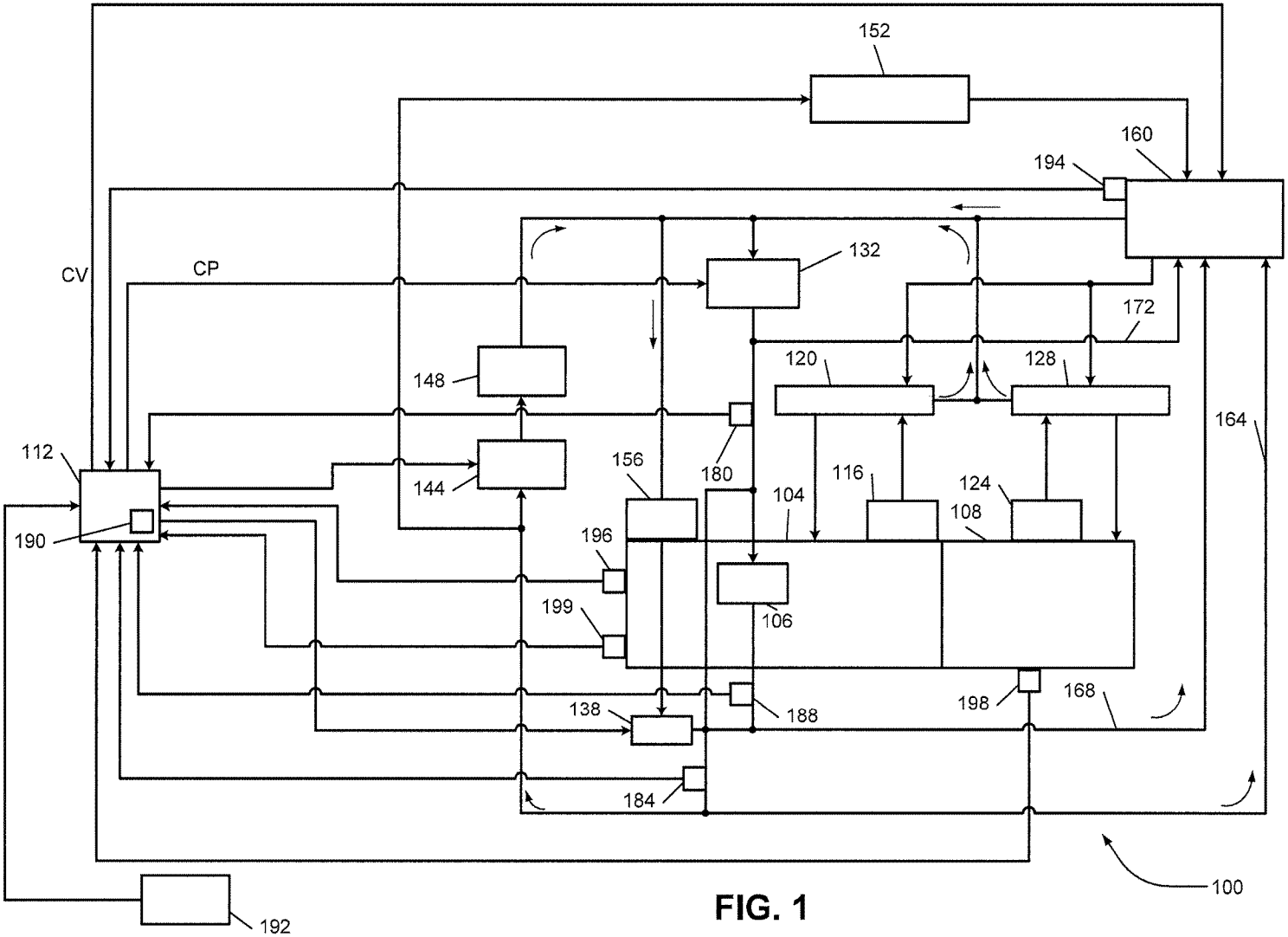
FIG. 1 is a functional block diagram of an example vehicle system according to the present disclosure.

An engine combusts air and fuel in a combustion chamber of a cylinder to generate drive torque. For example, during combustion, a piston may reciprocate within the cylinder to generate the drive torque. Engine oil may be used to lubricate the moving piston and other moving parts in the engine. Piston rings can be used to sealingly separate fuel in the combustion chamber from engine oil used to lubricate the piston.

The engine also includes an integrated exhaust manifold (IEM) that receives exhaust resulting from combustion within cylinders of the engine. The exhaust flows through the IEM and one or more components of an exhaust system before the exhaust is expelled to the atmosphere.

A coolant system circulates coolant through various portions of the engine, such as a cylinder head, an engine block, and the IEM. Traditionally, the coolant system is used to absorb heat from the engine, engine oil, transmission fluid, and other components and to transfer heat to air. For example, coolant may circulate through an engine oil heat exchanger and/or a transmission heat exchanger to absorb heat from the engine oil and/or the transmission fluid, respectively.

Under some circumstances, fuel may enter, and mix with, the engine oil. For example, as the pistons reciprocate within the cylinder during combustion, fuel may enter the engine oil from around the piston rings. Accordingly, the engine oil may include a mixture of engine oil and fuel, defining an oil fuel fraction (i.e., a ratio of a quantity of fuel within a quantity of engine oil). Lubricity of the engine oil is inversely related to the oil fuel fraction. Thus, as the oil fuel fraction increases, the lubricity of the engine oil decreases. The lubricity of the engine oil impacts the amount of energy lost to friction within the engine, and therefore impacts the design and durability of various components within the engine.

Under some circumstances, the engine oil may be cold, such as when a vehicle is started. When the engine oil is heated, the fuel within the engine oil evaporates and is purged, thus reducing the oil fuel fraction and increasing the lubricity of the engine oil.

When the oil fuel fraction is greater than a predetermined value, a coolant control module according to the present disclosure may actuate a coolant valve to control a flow of coolant from the IEM to the engine oil heat exchanger and/or to the transmission heat exchanger. The coolant warmed by the IEM warms the engine oil flowing through the engine oil heat exchanger and/or the transmission fluid flowing through the transmission heat exchanger. Warming the engine oil using coolant that is warmed by the IEM may more quickly purge fuel from the engine oil, and therefore more quickly decrease the oil fuel fraction and increase the lubricity of the engine oil.

When the transmission is greater than a predetermined transmission temperature and/or the engine oil is greater than a predetermined engine oil temperature, the coolant control module may actuate the coolant valve to prevent the flow of coolant from the IEM to the engine oil heat exchanger and/or to the transmission heat exchanger.

Referring now to FIG. 1, a functional block diagram of an example vehicle system is presented. An engine 104 combusts a mixture of air and fuel within cylinders to generate drive torque. An integrated exhaust manifold (IEM) 106 receives exhaust output from the cylinders and is integrated with a portion of the engine 104, such as a head portion of the engine 104.

The engine 104 outputs torque to a transmission 108. The transmission 108 transfers torque to one or more wheels of a vehicle via a driveline (not shown). An engine control module (ECM) 112 may control one or more engine actuators to regulate the torque output of the engine 104.

An engine oil pump 116 circulates engine oil through the engine 104 and a first heat exchanger 120. The first heat exchanger 120 may be referred to as an (engine) oil cooler or an oil heat exchanger (HEX). When the engine oil is cold, the first heat exchanger 120 may transfer heat to engine oil within the first heat exchanger 120 from coolant flowing through the first heat exchanger 120. The first heat exchanger 120 may transfer heat from the engine oil to coolant flowing through the first heat exchanger 120 and/or to air passing the first heat exchanger 120 when the engine oil is warm.

Viscosity of the engine oil is inversely related to temperature of the engine oil. That is, viscosity of the engine oil decreases as the temperature increases and vice versa. Frictional losses (e.g., torque losses) of the engine 104 associated with the engine oil may decrease as viscosity of the engine oil decreases and vice versa.

A transmission fluid pump 124 circulates transmission fluid through the transmission 108 and a second heat exchanger 128. The second heat exchanger 128 may be referred to as a transmission cooler or as a transmission heat exchanger. When the transmission fluid is cold, the second heat exchanger 128 may transfer heat to transmission fluid within the second heat exchanger 128 from coolant flowing through the second heat exchanger 128. The second heat exchanger 128 may transfer heat from the transmission fluid to coolant flowing through the second heat exchanger 128 and/or to air passing the second heat exchanger 128 when the transmission fluid is warm.

Viscosity of the transmission fluid is inversely related to temperature of the transmission fluid. That is, viscosity of the transmission fluid decreases as the temperature of the transmission fluid increases and vice versa. Losses (e.g., torque losses) associated with the transmission 108 and the transmission fluid may decrease as viscosity of the transmission fluid decreases and vice versa.

The engine 104 includes a plurality of channels through which engine coolant ("coolant") can flow. For example, the engine 104 may include one or more channels through the head portion of the engine 104, one or more channels through a block portion of the engine 104, and/or one or more channels through the IEM 106. The engine 104 may also include one or more other suitable coolant channels.

When a coolant pump 132 is on, the coolant pump 132 pumps coolant to the channels of the engine 104. While the coolant pump 132 is shown and will be discussed as an electric coolant pump, the coolant pump 132 may alternatively be mechanically driven (e.g., by the engine 104) or another suitable type of coolant pump.

A block valve (BV) 138 may regulate coolant flow out of (and therefore through) the block portion of the engine 104. A heater valve 144 may regulate coolant flow to (and therefore through) a third heat exchanger 148. The third heat exchanger 148 may also be referred to as a heater core. Air may be circulated past the third heat exchanger 148, for example, to warm a passenger cabin of the vehicle.

Coolant output from the engine 104 also flows to a fourth heat exchanger 152. The fourth heat exchanger 152 may be referred to as a radiator. The fourth heat exchanger 152 transfers heat to air passing the fourth heat exchanger 152. A cooling fan (not shown) may be implemented to increase airflow passing the fourth heat exchanger 152.

Various types of engines may include one or more turbochargers, such as turbocharger 156. Coolant may be circulated through a portion of the turbocharger 156, for example, to cool the turbocharger 156.

A coolant valve 160 may include a multiple input, multiple output valve or one or more other suitable valves. In various implementations, the coolant valve 160 may be partitioned and have two or more separate chambers. An example diagram illustrating coolant flow to and from an example where the coolant valve 160 includes 2 coolant chambers is provided in FIG. 2. The ECM 112 controls actuation of the coolant valve 160.

Figure 2:
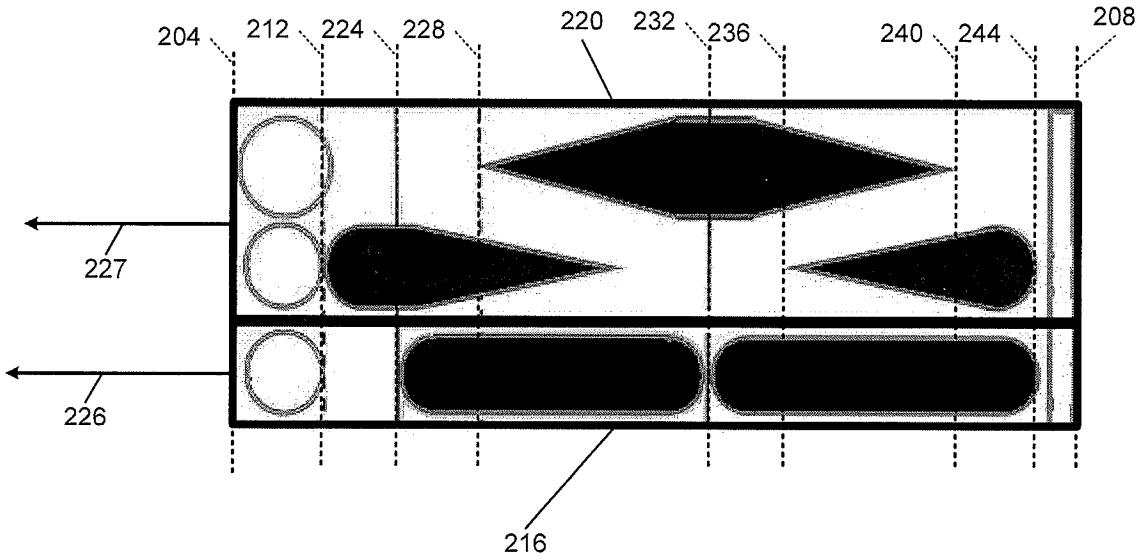
FIG. 2 is an example diagram illustrating coolant flow to and from a coolant valve for various positions of the coolant valve.

Referring now to FIGS. 1 and 2, the coolant valve 160 can be actuated between two end positions 204 and 208. When the coolant valve 160 is positioned between the end position 204 and a first position 212, coolant flow into a first one of the chambers 216 is blocked, and coolant flow into a second one of the chambers 220 is blocked. The coolant valve 160 outputs coolant from the first one of the chambers 216 to the first heat exchanger 120 and/or the second heat exchanger 128 as indicated by 226. In this regard, while the coolant valve 160 is generally shown and described herein as outputting coolant to the both the first and second heat exchangers 120, 128 at 226, the coolant valve 160 may output coolant to only the first heat exchanger 120 at 226. The coolant valve 160 outputs coolant from the second one of the chambers 220 to the coolant pump 132 as indicated by 227.

When the coolant valve 160 is positioned between the first position 212 and a second position 224, coolant flow into the first one of the chambers 216 is blocked and coolant output by the engine 104 flows into the second one of the chambers 220 via a first coolant path 164. Coolant flow into the second one of the chambers 220 from the fourth heat exchanger 152, however, is blocked.

When the coolant valve 160 is positioned between the second position 224 and a third position 228, coolant output by the IEM 106 via a second coolant path 168 flows into the first one of the chambers 216, coolant output by the engine 104 flows into the second one of the chambers 220 via the first coolant path 164, and coolant flow into the second one of the chambers 220 from the fourth heat exchanger 152 is blocked. The ECM 112 may actuate the coolant valve 160 to between the second and third positions 224 and 228, for example, to warm the engine oil and the transmission fluid.

When the coolant valve 160 is positioned between the third position 228 and a fourth position 232, coolant output by the IEM 106 via the second coolant path 168 flows into the first one of the chambers 216, coolant output by the engine 104 flows into the second one of the chambers 220 via the first coolant path 164, and coolant output by the fourth heat exchanger 152 flows into the second one of the chambers 220. Coolant flow into the first one of the chambers 216 from the coolant pump 132 via a third coolant path 172 is blocked when the coolant valve 160 is between the end position 204 and the fourth position 232. The ECM 112 may actuate the coolant valve 160 to be between the third and fourth positions 228 and 232, for example, to warm the engine oil and the transmission fluid.

When the coolant valve 160 is positioned between the fourth position 232 and a fifth position 236, coolant output by the coolant pump 132 flows into the first one of the chambers 216 via the third coolant path 172, coolant flow into the second one of the chambers 220 via the first coolant path 164 is blocked, and coolant output by the fourth heat exchanger 152 flows into the second one of the chambers 220. When the coolant valve 160 is positioned between the fifth position 236 and a sixth position 240, coolant output by the coolant pump 132 flows into the first one of the chambers 216 via the third coolant path 172, coolant output by the engine 104 flows into the second one of the chambers 220 via the first coolant path 164, and coolant output by the fourth heat exchanger 152 flows into the second one of the chambers 220.

When the coolant valve 160 is positioned between the sixth position 240 and a seventh position 244, coolant output by the coolant pump 132 flows into the first one of the chambers 216 via the third coolant path 172, coolant output by the engine 104 flows into the second one of the chambers 220 via the first coolant path 164, and coolant flow from the fourth heat exchanger 152 into the second one of the chambers 220 is blocked.

Coolant flow into the first one of the chambers 216 from the IEM 106 via the second coolant path 168 is blocked when the coolant valve 160 is between the fourth position 232 and the seventh position 244. The ECM 112 may actuate the coolant valve 160 to between the fourth and seventh positions 232 and 244, for example, to cool the engine oil and the transmission fluid. Coolant flow into the first and second chambers 216 and 220 is blocked when the coolant valve 160 is positioned between the seventh position 244 and the end position 208. The ECM 112 may actuate the coolant valve 160 to between the seventh position 244 and the end position 208, for example, for performance of one or more diagnostics.

Referring back to FIG. 1, a coolant input temperature sensor 180 measures a temperature of coolant input to the engine 104. A coolant output temperature sensor 184 measures a temperature of coolant output from the engine 104.

An IEM coolant temperature sensor 188 measures a temperature of coolant output from the IEM 106. A coolant valve position sensor 194 measures a position of the coolant valve 160. An oil temperature sensor 196 measures a temperature of engine oil, such as within the engine 104. A transmission fluid temperature sensor 198 measures a temperature of transmission fluid, such as within the transmission 108. An oil fuel fraction sensor 199 measures an amount of fuel in the engine oil (i.e., the oil fuel fraction), such as within the engine 104. One or more other sensors 192 may be implemented, such as one or more engine (e.g., block and/or head) temperature sensors, a radiator output temperature sensor, a crankshaft position sensor, a mass air flowrate (MAF) sensor, a manifold absolute pressure (MAP) sensor, and/or one or more other suitable vehicle sensors. One or more other heat exchangers may also be implemented to aid in cooling and/or warming of vehicle fluid(s) and/or components.

Output of the coolant pump 132 varies as the pressure of coolant input to the coolant pump 132 varies. For example, at a given speed of the coolant pump 132, the output of the coolant pump 132 increases as the pressure of coolant input to the coolant pump 132 increases, and vice versa. The position of the coolant valve 160 varies the pressure of coolant input to the coolant pump 132.

A coolant control module 190 (see also FIG. 2) controls coolant flow to warm the engine oil and the transmission fluid using coolant output from the IEM 106. Warming the transmission fluid using coolant output from the IEM 106 quickly warms the transmission fluid and therefore decreases torque losses associated with the transmission fluid temperature. Warming the engine oil using coolant output from the IEM 106 quickly warms the engine oil and therefore reduces the amount of fuel in the engine oil (i.e., the oil fuel fraction) such that the lubricity of the engine oil increases. While the coolant control module 190 is shown as being implemented within the ECM 112, the coolant control module 190 or one or more portions of the coolant control module 190 may be implemented within another module or independently.

Figure 3:
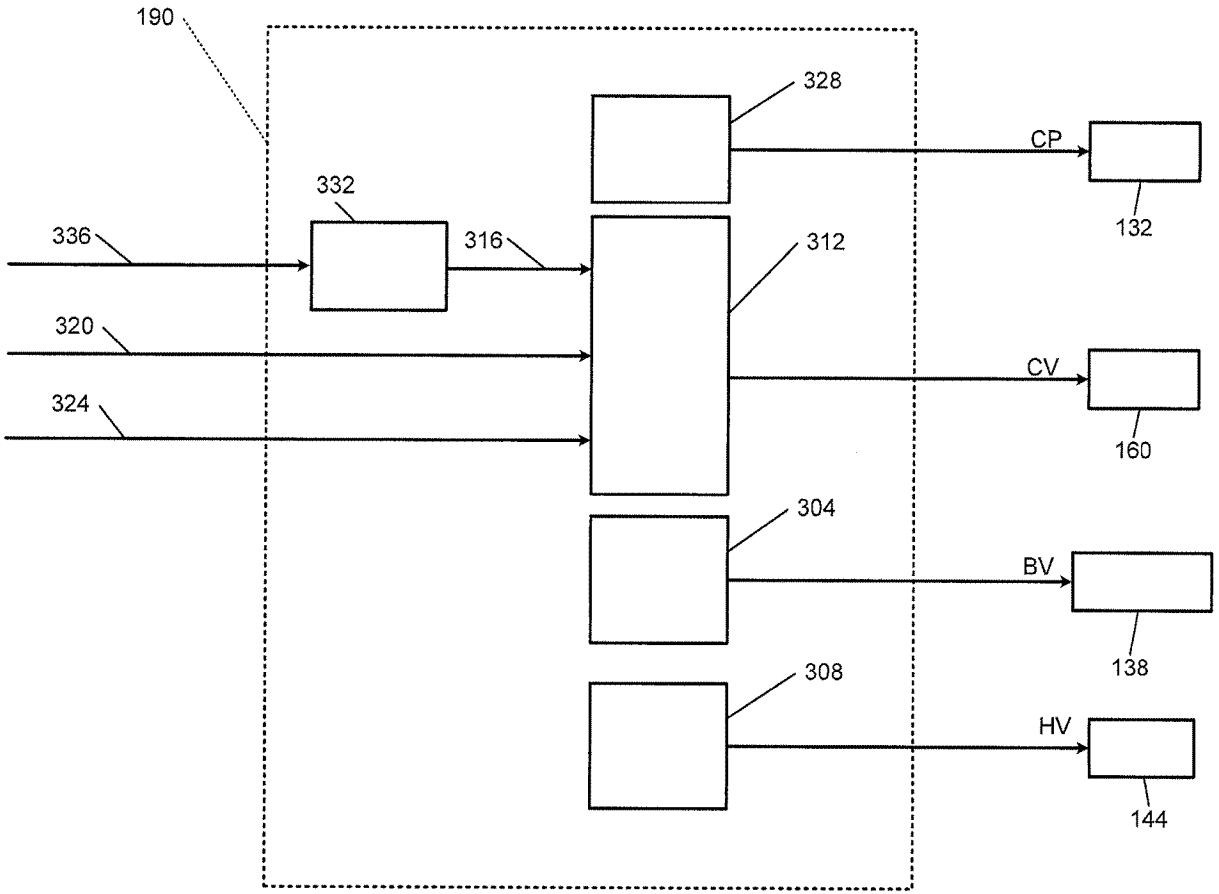
FIG. 3 is a functional block diagram of an example coolant control module according to the present disclosure.

Referring now to FIG. 3, a functional block diagram of an example implementation of the coolant control module 190 is presented. A block valve control module 304 controls the block valve 138. For example, the block valve control module 304 controls whether the block valve 138 is open (to allow coolant flow through the block portion of the engine 104) or closed (to prevent coolant flow through the block portion of the engine 104).

A heater valve control module 308 controls the heater valve 144. For example, the heater valve control module 308 controls whether the heater valve 144 is open (to allow coolant flow through the third heat exchanger 148) or closed (to prevent coolant flow through the third heat exchanger 148).

A pump control module 328 controls the speed of the coolant pump 132 according to a desired engine coolant output temperature and a corresponding coolant flow rate. In other words, the pump control module 328 controls the speed of the coolant pump 132 to generate a coolant flow rate to achieve the desired engine coolant output temperature. The speed of the coolant pump 132 required to achieve the desired engine coolant output temperature at a given position of the coolant valve 160 may be calibrated based on, for example, an initial vehicle condition. For example, the pump control module 328 may disable the coolant pump 132 when an oil fuel fraction is less than a predetermined oil fuel fraction, or when a transmission temperature is greater than a predetermined transmission temperature, or when an oil temperature is greater than a predetermined oil temperature. Conversely, the pump control module 328 may activate the coolant pump 132 when the oil fuel fraction is less than the predetermined oil fuel fraction, and when the transmission temperature is greater than the predetermined transmission temperature, and when the oil temperature is greater than the predetermined oil temperature. If the coolant pump 132 is a mechanically driven coolant pump, the pump control module 204 may be omitted.

A coolant valve control module 312 controls the coolant valve 160. The coolant valve control module 312 may provide a signal to the pump control module 328 indicating the selected position of the coolant valve 160. In this manner, the pump control module 328 controls the speed of the coolant pump 132 for the selected position of the coolant valve 160.

As described above, the position of the coolant valve 160 controls coolant flow into the chambers of the coolant valve 160 and also controls coolant flow out of the coolant valve 160. More specifically, the coolant valve control module 312 controls whether the coolant valve 160 outputs coolant to the first heat exchanger 120, the second heat exchanger 128, both the first and second heat exchangers 120 and 128, or neither of the first and second heat exchangers 120 and 128. For example, as described above, when the coolant valve 160 is between the second and fourth positions 224 and 232 (FIG. 2), the coolant valve 160 may output coolant to the first and second heat exchangers 120 and 128.

The coolant valve control module 312 may control the coolant valve 160, for example, based on an oil fuel fraction 316, a transmission temperature 320, and an engine oil temperature 324. The transmission temperature 320 and the engine oil temperature 324 may be, for example, measured using the transmission temperature sensor 198 and the oil temperature sensor 196, respectively.

A fraction module 332 may determine the oil fuel fraction 316. In some configurations, the fraction module 332 may receive a signal 336 from the oil fuel fraction sensor 199 defining the oil fuel fraction 316. In other configurations, the fraction module 332 may calculate the oil fuel fraction 316 based on the signal 336. When the oil fuel fraction 316 is greater than a predetermined oil fuel fraction, and when the transmission temperature 320 is less than a predetermined transmission temperature, the coolant valve control module 312 controls the coolant valve 160 to direct the flow of coolant from the IEM 106, through the coolant valve 160, and to the first and second heat exchangers 120 and 128, in the manner described above.

The predetermined oil fuel fraction may be calibratable and may be set based on an oil fuel fraction above which the lubricity of the engine oil, and/or the performance of the engine 104, may be adversely impacted. The predetermined oil fuel fraction may be between 1% and 5%. For example only, the predetermined oil fuel fraction may be approximately 3%-4%. The predetermined transmission temperature may, likewise, be calibratable and may be set based on a temperature above which coolant flowing through the IEM 106 may increase the transmission temperature to a value that could hinder the performance of the transmission 108. For example only, the predetermined transmission temperature may be approximately 125° Celsius or another suitable temperature.

The coolant valve control module 312 controls the flow of coolant from the higher temperature IEM 106 to the lower temperature first and second heat exchangers 120 and 128, in order to increase the engine oil temperature 324 and the transmission temperature 320, respectively. Coolant within the channels through the IEM 106 may absorb heat from the IEM 106. The IEM 106 receives heat from exhaust resulting from combustion within the engine 104.

Coolant flowing from the IEM 106 to the first and second heat exchangers 120 and 128 (through the coolant valve 160) warms the engine oil within the first heat exchanger 120 and warms the transmission fluid within the second heat exchanger 128. The warming of the transmission fluid and the transmission 108 decreases losses associated with the transmission 108 and the transmission fluid. The decrease in the losses may decrease fuel consumption. The warming of the engine oil evaporates the fuel within the engine oil, and thereby increases the lubricity of the engine oil and decreases losses associated with the engine 104 and the engine oil.

When (i) the engine oil temperature 324 exceeds a predetermined engine oil temperature (e.g., 140° Celsius or another suitable temperature), (ii) the transmission temperature 320 exceeds the predetermined transmission temperature, and/or (iii) the oil fuel fraction 316 exceeds the predetermined oil fuel fraction, the coolant valve control module 312 controls the coolant valve 160 to prevent the flow of coolant from the IEM 106 to the first and/or second heat exchangers 120 and 128, in the manner described above. In this manner, the coolant valve control module 312 ensures that the coolant flowing through the higher temperature IEM 106 does not overheat the transmission fluid and/or the engine oil. While the coolant valve control module 312 is generally shown and described herein as providing coolant flow to both the first and second heat exchangers 120, 128, in other configurations, the transmission temperature may be ignored and coolant flow may not be provided to the second heat exchanger 128 when the oil fuel fraction 316 is less than the predetermined oil fuel fraction.

Figure 4:
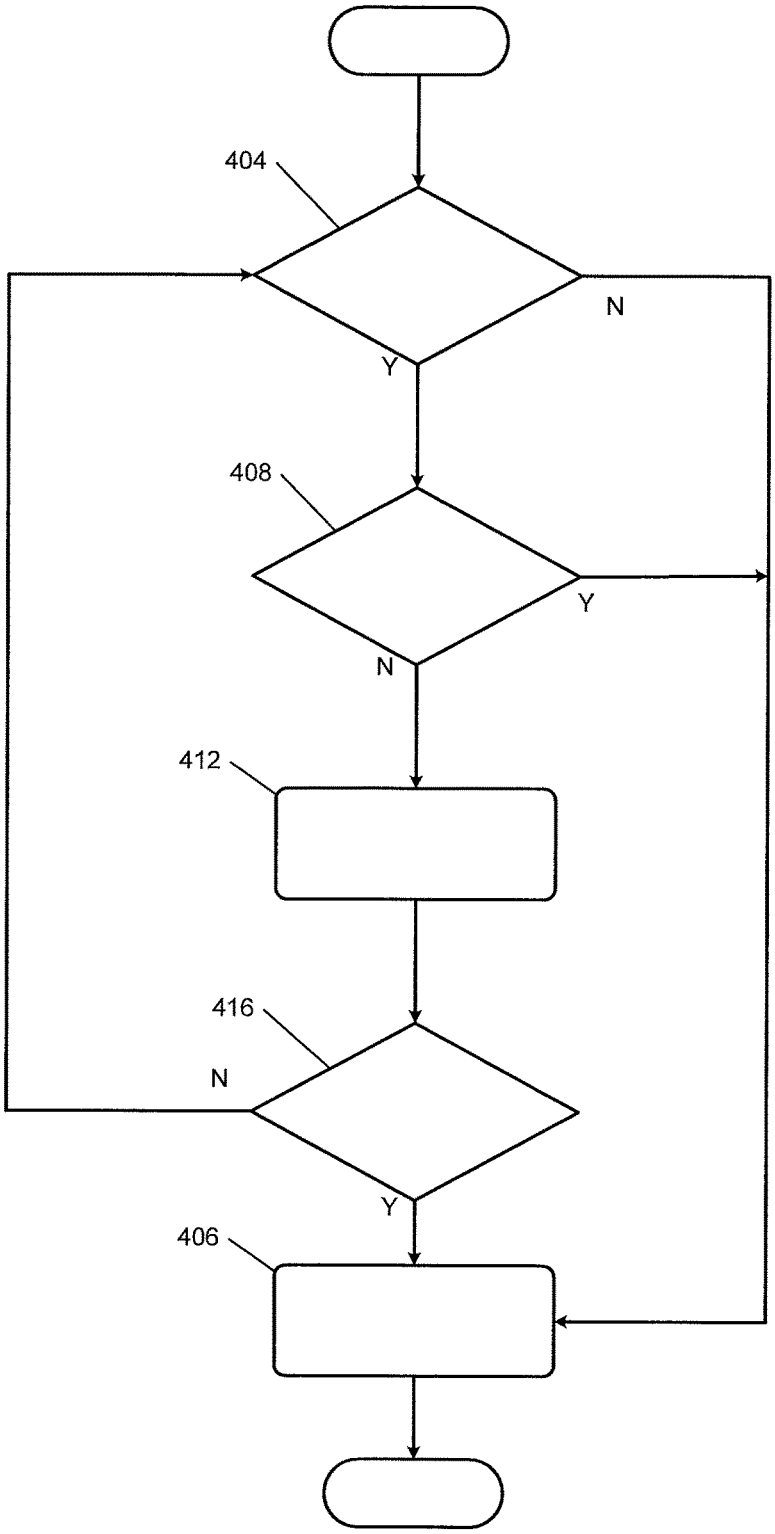
FIG. 4 is a flowchart depicting an example method of controlling coolant flow according to the present disclosure.

Referring now to FIG. 4, a flowchart is presented depicting an example method of controlling coolant flow to dilute an amount of fuel present in the engine oil (i.e., a method of reducing an oil fuel fraction). Control may begin at 404 where the coolant valve control module 312 determines whether the oil fuel fraction is greater than a predetermined oil fuel fraction. As discussed above, the predetermined oil fuel fraction may be 3%-4%, or another suitable value above which the amount of fuel in the engine oil may be considered high enough to adversely affect the lubricity of the engine oil, and/or adversely affect the performance of the engine 104.

If 404 is false, control continues to 406 where the coolant valve control module 312 controls the coolant valve 160 to prevent the flow of coolant from the IEM 106 to the first and/or second heat exchangers 120 and 128. If 404 is true, control continues to 408, where the coolant valve control module 312 determines whether the transmission temperature is greater than the predetermined transmission temperature. If 408 is true, control continues to 406. If 408 is false, control continues to 412.

At 412, the coolant valve control module 312 controls the flow of coolant from the IEM 106 to the first heat exchanger 120 and to the second heat exchanger 128. In particular, the coolant valve control module 312 may actuate the coolant valve 160 to enable coolant flow from the IEM 106 through the coolant valve 160 to the first and second heat exchangers 120, 128 at 412. For example, the coolant valve control module 312 may actuate the coolant valve 160 for a predetermined amount of time at 412.

As discussed above, enabling the flow of coolant from the IEM 106 to the first and second heat exchangers 120, 128 allows the coolant to heat the engine oil and the transmission fluid flowing through the first and second heat exchangers 120, 128, respectively. Heating the engine oil with the coolant in the first heat exchanger 120 enables the evaporation of fuel from the engine oil.

At 416, the coolant valve control module 312 determines whether the engine oil temperature is greater than the predetermined engine oil temperature. If 416 is true, control continues to 406. In particular, if the oil temperature is greater than the predetermined engine oil temperature, control may determine that controlling coolant flow to dilute an amount of fuel present in the engine oil is no longer necessary (e.g., the evaporation of fuel from the engine oil is complete), and may prevent the flow of coolant from the IEM 106 to the first and/or second heat exchangers 120 and 128 prior to exiting the control. If 416 is false, control returns to 404.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

In this application, including the definitions below, the term module may be replaced with the term circuit. The term module may refer to, be part of, or include an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor (shared, dedicated, or group) that executes code; memory (shared, dedicated, or group) that stores code executed by a processor; other suitable hardware components that provide the described functionality; or a combination of some or all of the above, such as in a system-on-chip.

The term code, as used above, may include software, firmware, and/or microcode, and may refer to programs, routines, functions, classes, and/or objects. The term shared processor encompasses a single processor that executes some or all code from multiple modules. The term group processor encompasses a processor that, in combination with additional processors, executes some or all code from one or more modules. The term shared memory encompasses a single memory that stores some or all code from multiple modules. The term group memory encompasses a memory that, in combination with additional memories, stores some or all code from one or more modules. The term memory may be a subset of the term computer-readable medium. The term computer-readable medium does not encompass transitory electrical and electromagnetic signals propagating through a medium, and may therefore be considered tangible and non-transitory. Non-limiting examples of a non-transitory tangible computer readable medium include nonvolatile memory, volatile memory, magnetic storage, and optical storage.

The apparatuses and methods described in this application may be partially or fully implemented by one or more computer programs executed by one or more processors.

The computer programs include processor-executable instructions that are stored on at least one non-transitory tangible computer readable medium. The computer programs may also include and/or rely on stored data.

What is claimed is:

1. A coolant control system of a vehicle, comprising:

a fraction module that determines an oil fuel fraction based on an amount of fuel in an amount of engine oil; and a coolant valve control module that, based on the oil fuel fraction, selectively actuates a coolant valve to enable coolant flow from an integrated exhaust manifold (IEM) of an engine to an engine oil heat exchanger.

2. The system of claim 1, wherein the coolant valve control module actuates the coolant valve to enable coolant flow from the IEM to the engine oil heat exchanger when the oil fuel fraction is greater than a predetermined value.

3. The system of claim 2, wherein the coolant valve control module actuates the coolant valve to prevent coolant flow from the IEM to the engine oil heat exchanger when the oil fuel fraction is less than the predetermined value.

4. The system of claim 1, wherein the coolant valve control module selectively actuates the coolant valve to control coolant flow from the IEM to the engine oil heat exchanger further based on at least one of a transmission temperature and an engine oil temperature.

5. The system of claim 4, wherein the coolant valve control module actuates the coolant valve to enable coolant flow from the IEM to the engine oil heat exchanger when:

(i) the transmission temperature is less than a predetermined temperature; and (ii) the oil fuel fraction is greater than a predetermined value.

6. The system of claim 5, wherein the coolant valve control module selectively actuates the coolant valve to prevent coolant flow of from the IEM to the engine oil heat exchanger when the transmission temperature is greater than the predetermined temperature.

7. The system of claim 5, wherein the coolant valve control module actuates the coolant valve to prevent coolant flow from the IEM to the engine oil heat exchanger when the oil fuel fraction is greater than the predetermined value.

8. The system of claim 4, wherein the coolant valve control module actuates the coolant valve to enable coolant flow from the IEM to the engine oil heat exchanger when:

(i) the engine oil temperature is less than a predetermined temperature; and (ii) the oil fuel fraction is greater than a predetermined value.

9. The system of claim 8, wherein the coolant valve control module selectively actuates the coolant valve to prevent coolant flow of from the IEM to the engine oil heat exchanger when the engine oil temperature is greater than the predetermined temperature.

10. The system of claim 9, wherein the coolant valve control module actuates the coolant valve to prevent coolant flow from the IEM to the engine oil heat exchanger when the oil fuel fraction is greater than the predetermined value.

11. A coolant control method for a vehicle, comprising:

determining an oil fuel fraction based on an amount of fuel in an amount of engine oil; and based on the oil fuel fraction, selectively actuating a coolant valve to enable coolant flow from an integrated exhaust manifold (IEM) of an engine to an engine oil heat exchanger.

12. The method of claim 11 wherein selectively actuating the coolant valve includes actuating the coolant valve to enable coolant flow from the IEM to the engine oil heat exchanger when the oil fuel fraction is greater than a predetermined value.

13. The method of claim 12 wherein selectively actuating the coolant valve includes actuating the coolant valve to prevent coolant flow from the IEM to the engine oil heat exchanger when the oil fuel fraction is less than the predetermined value.

14. The method of claim 11 further comprising selectively actuating the coolant valve to control coolant flow from the IEM to the engine oil heat exchanger further based on at least one of a transmission temperature and an engine oil temperature.

15. The method of claim 14 wherein selectively actuating the coolant valve includes actuating the coolant valve to enable coolant flow from the IEM to the engine oil heat exchanger when:

(i) the transmission temperature is less than a predetermined temperature; and (ii) the oil fuel fraction is greater than a predetermined value.

16. The method of claim 15 wherein selectively actuating the coolant valve includes actuating the coolant valve to prevent coolant flow of from the IEM to the engine oil heat exchanger when the transmission temperature is greater than the predetermined temperature.

17. The method of claim 15 wherein selectively actuating the coolant valve includes actuating the coolant valve to prevent coolant flow from the IEM to the engine oil heat exchanger when the oil fuel fraction is greater than the predetermined value.

18. The method of claim 14 wherein selectively actuating the coolant valve includes actuating the coolant valve to enable coolant flow from the IEM to the engine oil heat exchanger when:

(i) the engine oil temperature is less than a predetermined temperature; and (ii) the oil fuel fraction is greater than a predetermined value.

19. The method of claim 18 wherein selectively actuating the coolant valve includes actuating the coolant valve to prevent coolant flow of from the IEM to the engine oil heat exchanger when the engine oil temperature is greater than the predetermined temperature.

20. The method of claim 19 wherein selectively actuating the coolant valve includes actuating the coolant valve to prevent coolant flow from the IEM to the engine oil heat exchanger when the oil fuel fraction is greater than the predetermined value.

* * * * *